US006799643B2

(12) United States Patent
Voulkidis et al.

(10) Patent No.: US 6,799,643 B2
(45) Date of Patent: Oct. 5, 2004

(54) PERCUSSION ELECTRICAL HAND-HELD TOOL

(75) Inventors: Orestis Voulkidis, Eschen (DE); Hans Boni, Buchs/SG (CH)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/318,934

(22) Filed: Dec. 12, 2002

(65) Prior Publication Data

US 2003/0116333 A1 Jun. 26, 2003

(30) Foreign Application Priority Data

Dec. 12, 2001 (DE) ..... 101 60 864

(51) Int. Cl.[7] ..... B27C 3/08

(52) U.S. Cl. ..... 173/170; 173/11; 173/2; 173/162.2

(58) Field of Search ..... 173/2, 4, 11, 201, 173/170, 162.2

(56) References Cited

U.S. PATENT DOCUMENTS 2,425,245 A * 8/1947 Johnson ..... 16/431
4,282,938 A * 8/1981 Minamidate ..... 173/162.2
4,341,271 A * 7/1982 Anttila ..... 175/24
4,421,181 A * 12/1983 Andersson et al. ..... 173/162.2
5,025,870 A * 6/1991 Gantner ..... 173/162.2
5,174,387 A * 12/1992 Arndt et al. ..... 173/1
5,337,835 A 8/1994 Bohne
6,044,918 A 4/2000 Noser et al.
6,076,616 A * 6/2000 Kramp et al. ..... 173/162.2
6,520,266 B2 * 2/2003 Bongers-Ambrosius et al. . 173/2
6,590,171 B1 * 7/2003 Wolf et al. ..... 200/51 LM

* cited by examiner

*Primary Examiner*—John Sipos
*Assistant Examiner*—Louis Tran
(74) *Attorney, Agent, or Firm*—Sidley Austin Brown & Wood, LLP

(57) ABSTRACT

The present invention relates to a percussion electrical hand-held tool having an electronic control unit (5) for controlling at least one power parameter of the electrical tool, and a substantially flat force sensor for controlling operation of the electronic control unit (5) and arranged sliding displacement-free for sensing a press-on force (F, $F^1$) applied by a user in an operational direction of the electric tool, without being displaced, between at least two, associated with each other, press-surfaces (7*a*, 7*b*) extending at least partially transverse to a percussion axis (A) of the electrical tool.

13 Claims, 2 Drawing Sheets

PERCUSSION ELECTRICAL HAND-HELD TOOL

BACKGROUND OF THE INVENTION

1. Field of the Invention

The present invention relates to a percussion electrical hand-held tool such as trepan or a chisel power tool for working stone materials.

2. Description of the Prior Art

In the electrical hand-held tools of the type described above, an axial impact energy, which is generated by a percussion mechanism is transmitted to percussion working tool for working a workpiece. A portion of the energy, through the handle, acts on a tool user, causing disturbing vibrations in the user hand.

A large press-on force, which is applied to the handle, is associated, in percussion hand-held tools, with an intuitive desire to increase the break-down output. Contrary to that, in pure rotary tools, an increase press-on force leads to reduction of the rotational speed. Power parameters of a break-down work include, in particular, impact power, impact frequency, and optionally, rotational speed of the percussion power tool.

German Publication DE-19649468 discloses an electrical hand-held tool with control means being provided in the guide handle or in the auxiliary handle.

German Publication DE-3843960 discloses controlling an operation of control electronic of an electrical hand-held tool by a functional potentiometer with a pressure pad.

German Publication DE-19510365 discloses the use, in a functional potentionmeter, of a compressible medium in form of a fluid that is provided in the control member between a pressure plate and a sensor for transmitting pressure.

U.S. Pat. No. 4,250,434 discloses the use of a pressure-sensitive electrical sensor, which is formed as a flexible pressure hose, for controlling a machine.

German Publication DE-19703746 discloses an arrangement of a damping element on the rear gripping surface of a handle of an electrical hand-held tool.

U.S. Pat. No. 5,987,705 discloses a handle with a pressure sensor which controls a pump for generating a vibration suppressing inflation pressure.

German Publication DE-3316013 discloses a hammer drill with a control member or servo component arranged on the tool housing for steplessly controlling an impact energy of the hammer drill.

In German Publication DE-4231986, a mechanical control of the coupling of the percussion mechanism of a hammer drill is effected by using a press-on force applied by the power tool to a workpiece. However, the necessary, movable relative to each other and slidable on each other, parts cannot be used in the rough environment of the constructional industry, as the penetrating dust reduces the operational reliability of such electrical tool.

An object of the present invention is to provide a sliding movement-free, intuitive control of a power parameter, in particular, of an axial impact energy of a percussion electrical hand-held tool.

Another object of the present invention is to prevent transmission of vibration to a tool user hand.

SUMMARY OF THE INVENTION

These and other objects of the present invention, which will become apparent hereinafter, are achieved by providing a percussion electrical hand-held tool including an electronic control unit for controlling at least one power parameter of the electrical tool, and a pneumatic force sensor for controlling operation of the electronic control unit and arranged, free of sliding displacement, for sensing a press-on force applied by a user in an operational direction of the electric tool between at least two, associated with each other, press-services extending at least partially transverse to a percussion axis of the electrical tool.

The arrangement of the force sensor, according to the present invention, between associated press-surfaces for a displacement-free sensing of a press-on force for controlling a power parameter, can be safely used even in a rough environment.

Advantageously, the pneumatic force sensor is formed as a hollow pneumatic force transmission member connected with a force sensing element connectable with the electronic control unit.

Advantageously, the force transmission member is filled with an easily deformable, pressure transmitting medium or a fluid, pressure transmitting medium, e.g., pneumo-oil, gel, or high viscouls solid non-free flowing, non-evaporating material.

Advantageously, the hollow pneumatic force transmission member is formed as a cushion or hose the cross-section of which becomes compressed upon application of press-on force, and becomes deformed, which increases the hydrostatic pressure of the pressure transmitting medium.

Advantageously, the force sensor is located in a front section of the tool, behind an axial position of the tool chuck or behind the spindle bearing, which permits to measure the entire press-on force.

Advantageously, the force transmission member extends up to the handle, which makes possible to measure the entire press-on force acting on the force sensing element in the handle.

Advantageously, the press-surfaces are arranged, with respect to a force flux, between the percussion mechanism and a gripping surface of the handle.

More advantageously, the press-surfaces are arranged in a region of working tool-side, axial position of the percussion mechanism relative to a tool outer casing of which the handle forms a part, or in a region of a modular position of a drive module and a handle module.

Advantageously, the force transmission member extends transverse to the percussion axis and is arranged between the handle and a vibration-proof grripping casing, whereby the vibration in the pressure transmission medium are damped and are prevented from being transmitted to the user hand.

Advantageously, the tool side handle is also provided with a force-sensor forming, force transmission member provided with a force sensing element electrically connected, via signal conductors, with the force sensing element in the handle, whereby the sum of press-on forces of both the handle and the side handle are used for control purposes.

Alternatively, the force transmission member of the side handle can be connected directly with the force transmission element in the handle, which permits to use a common force sensing element, without the use, in the front portion of the power tool, current conducting conductors, which eliminates the safety problems associated with such conductors.

Advantageously, there is provided a low-pass filter with a cut-off voltage of less than 30 Hz between the control unit and the force sensor. The low-pass filter filters out the low frequency control signals and suppress the high frequency vibrations.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 1:
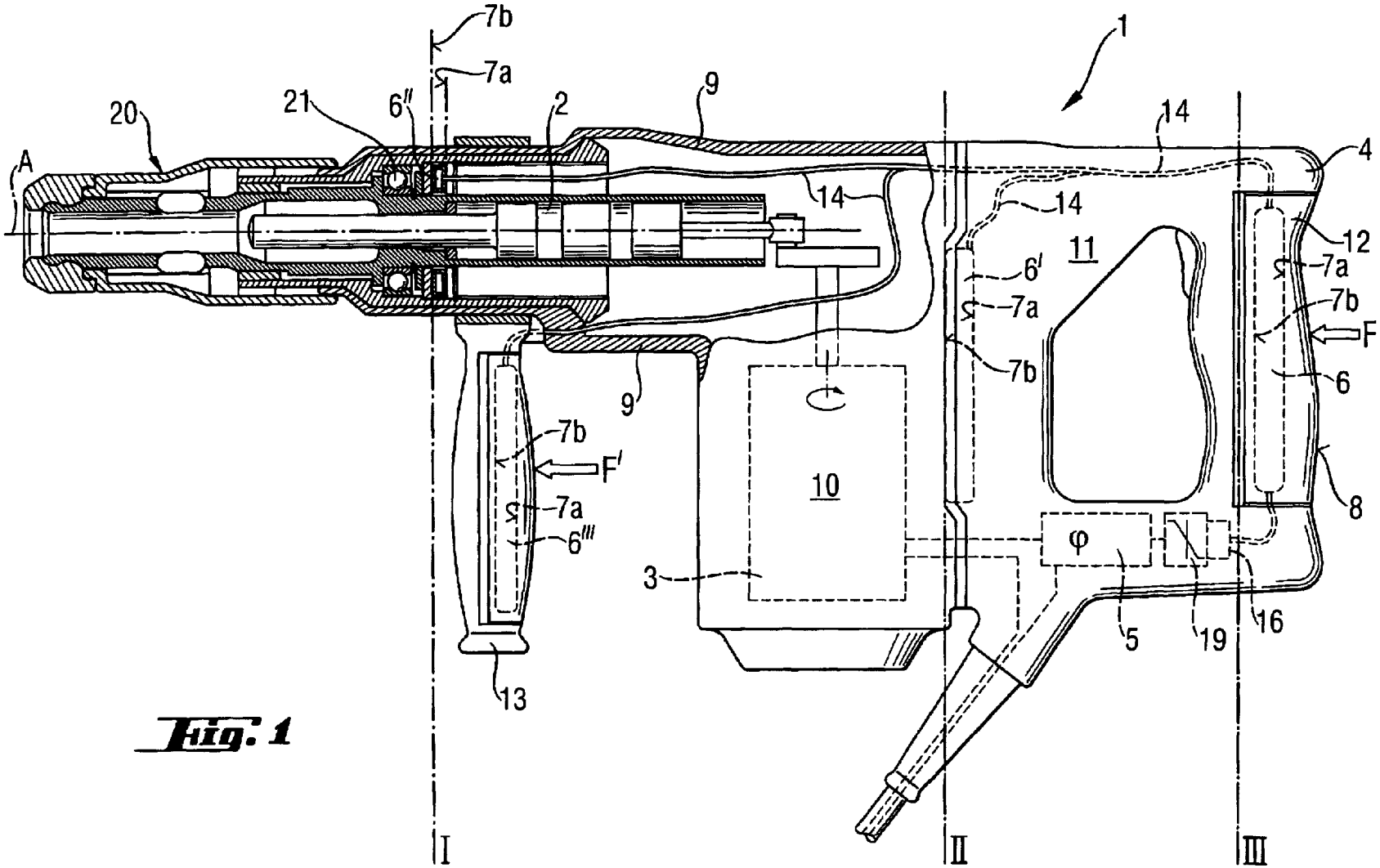
FIG. 1 a side, partially cross-sectional view of an electrical hand-held tool according to the present invention.

An axially percussion, electrical hand-held tool 1 according to the present invention, which is shown in FIG. 1, includes a percussion mechanism 2, an electrical motor 3 for driving the percussion mechanism 2, a handle 4, and a electronic control unit 5 formed as a phase-fired control unit. The phase-fired control unit 5 is itself controlled by a pneumatic force sensor 6 which is arranged transverse to the percussion axis a press-on force F applied by a user to the handle 4 in an operational direction of the electrical tool. The force sensor is arranged, free of any sliding movement, between two, associated with each other press-surfaces 7*a*, 7*b* provided between the percussion mechanism 2 and a gripping surface 8 of the handle 4.

In FIG. 1, three different arrangements of press-surfaces 7*a*, 7*b* are schematically shown. According to the first arrangement I, the press-surfaces 7*a*, 7*b* are arranged with respect to the force sensor, 6", at the working tool-side position of the percussion mechanism 2 with respect to the outer casing 9. According to the second arrangement II, the press-surfaces 7*a*, 7*b* are arranged, with respect to the force sensor 6' in the modular position of the drive module 10 with respect to the handle module 11. According to the third arrangement III, the press-surfaces 7*a*, 7*b* are arranged, with respect to the force sensor 6, between the handle 4 and a gripping casing 12 that is protected, to some extent, from vibrations by the flat sensor 6. A force sensor 6''' in a side handle is directly pneumatically connected with the handle 4 by a connection hose 14. The circular sensor 6" is arranged in the front section of the electrical tool 1 in the region of the axial position of a chuck 20, adjacent to a ball bearing 21, and is connected with the handle 4 by an extension of the connection hose 14 or is connected with the sensor 6.

Figure 2:
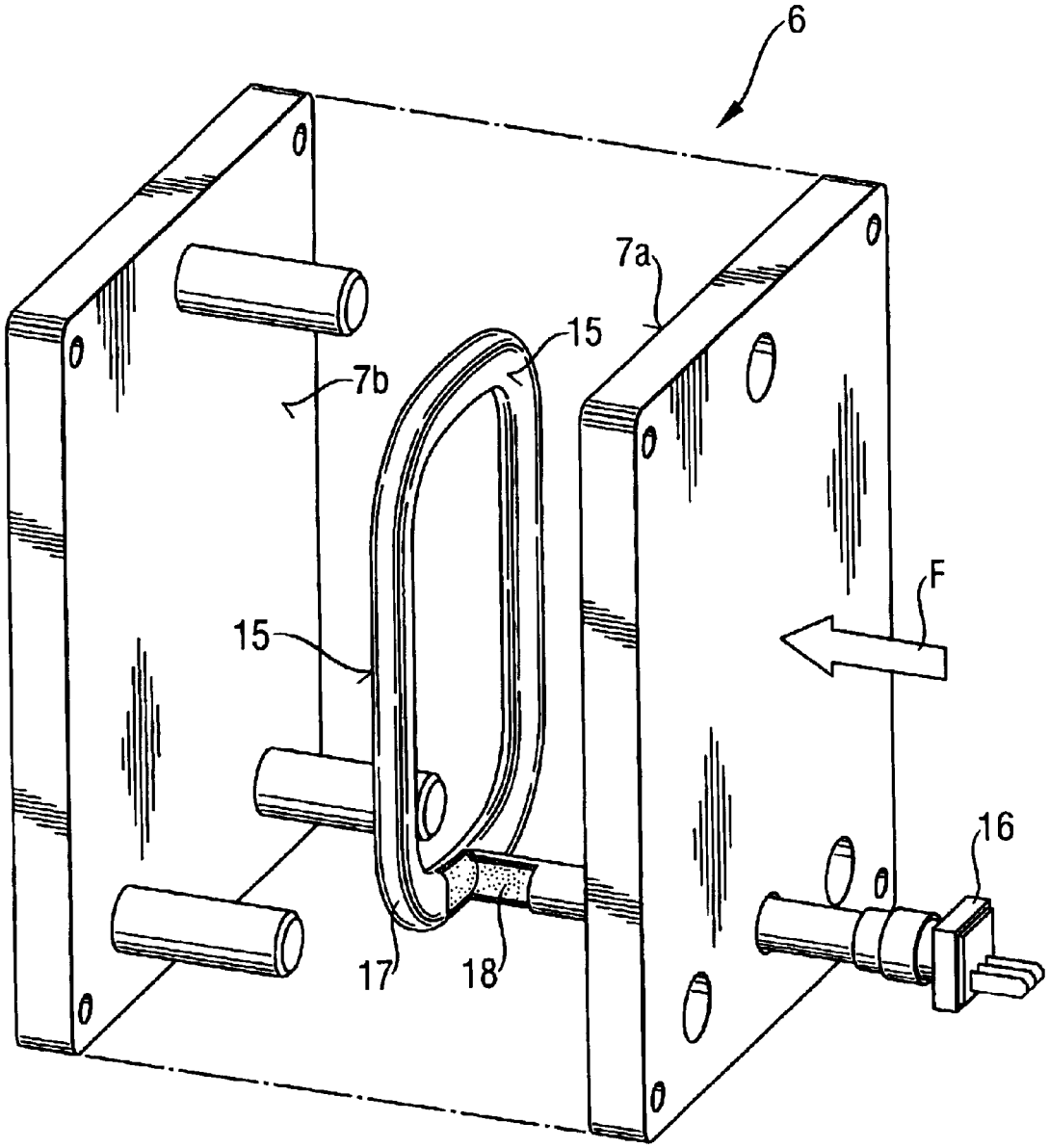
FIG. 2 a perspective view of a force sensor used in the inventive electrical hand held tool.

According to the embodiment, shown in FIG. 2, the pneumatic force sensor 6 is formed as a force transmission member 17 filled with pressure transmitting medium 18. The force-transmitting member 17 is formed as a rather flat closed hose having substantially parallel side surfaces 15. The force transmission member 17 is connected with a force sensing element 16 connected with the control unit 5 via a low-pass filter 19.

Though the present invention was shown and described with references to the preferred embodiment, such is merely illustrative of the present invention and are not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A percussion electrical hand-held tool, comprising a percussion mechanism (2); a handle (4); electronic control means (5) for controlling at least one power parameter of the electrical tool; and a force sensor (6, 6', 6") for controlling operation of the electronic control means (5) and which is formed as a hollow pneumatic force transmission member arranged, for sensing a press-on force (F, $F^1$) applied by a user in an operational direction of the electrical tool, free of sliding displacement, between at least two, associated with each other, press-surfaces (7*a*, 7*b*) extended at least partially transverse to a percussion axis (A) of the tool and arranged, with respect to a force flux, between the percussion mechanism (2) and a gripping surface (8) of the handle (4).

2. An electrical hand-held tool according to claim 1, wherein the force transmission member (17) is filled with one of an easily deformable pressure transmitting medium and a fluid pressure transmitting medium.

3. An electrical hand-held tool according to claim 1, further comprising an additional side handle (13) including a a further force sensor (6''') formed as a hollow pneumatic force transmission number.

4. An electrical hand-held tool according to claim 1, wherein the force transmission member (17) is formed as one of a cushion and a hose.

5. An electrical hand-held tool according to claim 1, wherein the force sensor (6") is located in a front section of the tool behind an axial position of an electrical tool chuck (20).

6. An electrical hand-held tool according to claim 1, wherein the force transmission member has a length substantially corresponding to a length of the handle (4).

7. An electrical hand-held tool according to claim 1, wherein the press-surfaces (7*a*, 7*b*) are arranged in a region of a working tool-side axial position of the percussion mechanism (2) relative to a tool outer casing (9) of which the handle (4) forms a part.

8. An electrical hand-held tool according to claim 1, wherein the press-surfaces (7*a*, 7*b*) are arranged in a region of a modular pesitlefi-ef between a drive module (10) and a handle module (11) of which the handle (4) forms a part.

9. An electrical hand-held tool according to claim 1, wherein the press-surfaces (7*a*, 7*b*) are arranged between the handle (4) and a vibration-proof gripping casing (12).

10. An electrical hand-held tool according to claim 1, wherein the force sensor (6) is connected with a force sensing element (16).

11. An electrical hand-held tool according to claim 10, further comprising a low-pass filter (19) having a cut-off frequency of less than 30 Hz for connecting the force sensing element (16) with the electronic control means.

12. An electrical hand-held tool according to claim 1, wherein the force sensor (6) is provided in the handle (4), and wherein the tool further comprises a side handle (13), a further force sensor (6''') formed as a hollow pneumatic force transmission member, and a connection hose (14) pneumatically connecting the further force sensor (6''') with the force sensor (6) provided in the handle (4).

13. An electrical hand-held tool according to claim 1, wherein a dimension of the force sensor in a direction parallel to a plane of a press-surface (7*a*, 7*b*) is substantially greater than a dimension of the force sensor in a direction perpendicular to the plane of the force sensor (7*a*, 7*b*).

* * * * *